US010005638B2

(12) United States Patent
Matthes et al.

(10) Patent No.: US 10,005,638 B2
(45) Date of Patent: Jun. 26, 2018

(54) CUTTING DEVICE

(71) Applicant: MUELLER MARTINI HOLDING AG, Hergiswil NW (CH)

(72) Inventors: Wolfgang Matthes, Wurzen/ OT Sachsendorf (DE); Andreas Steinert, Beucha (DE)

(73) Assignee: Mueller Martini Holding AG, Hergiswil NW (CH)

( * ) Notice: Subject to any disclaimer, the term of this patent is extended or adjusted under 35 U.S.C. 154(b) by 875 days.

(21) Appl. No.: 13/847,829

(22) Filed: Mar. 20, 2013

(65) Prior Publication Data

US 2013/0247735 A1 Sep. 26, 2013

(30) Foreign Application Priority Data

Mar. 20, 2012 (DE) ..... 10 2012 005 462

(51) Int. Cl.
*B26D 7/06* (2006.01)
*B65H 35/00* (2006.01)
(Continued)

(52) U.S. Cl.
CPC ..... *B65H 35/0086* (2013.01); *B26D 5/00* (2013.01); *B26D 7/015* (2013.01);
(Continued)

(58) Field of Classification Search
CPC ..... B26D 7/0633; B26D 1/00; B26D 5/00; B26D 2007/0081; B26D 2007/322; B65G 47/24; B65H 35/0086; Y10T 83/6579
(Continued)

(56) References Cited

U.S. PATENT DOCUMENTS 4,776,451 A * 10/1988 Gaddis ..... B65G 15/16 198/626.3
5,407,191 A * 4/1995 Ukai ..... B65H 43/00 271/202

(Continued)

FOREIGN PATENT DOCUMENTS

| | | | |
|---|---|---|---|
| EP | 1152310 | A1 | 11/2001 |
| JP | H06298403 | A | 10/1994 |
| JP | 2007062008 | A | 3/2007 |

OTHER PUBLICATIONS

Younkin, George W.: "I Basics of Industrial Servo Drives", In: "Industrial Servo Control Systems", Dec. 31, 2002, (Dec. 31, 2002), CRC Press, pp. 1-9, XP002699814, ISBN: 978-0-203-90945-4.

*Primary Examiner* — Kenneth E. Peterson
*Assistant Examiner* — Samuel A Davies
(74) *Attorney, Agent, or Firm* — Laurence A. Greenberg; Werner H. Stemer; Ralph E. Locher

(57) ABSTRACT

A device for simultaneous three-sided trimming of products in a plurality of cutting stations includes a common upper knife carrier operable in a vertical motion, blades to be attached to the upper knife carrier for at least front edge trimming and top and bottom trimming of the products and a first drive for driving the upper knife carrier. A conveyor system has top-related and bottom-related pairs of conveyor belts for conveying the products through the cutting stations of the device and a second drive driving the conveyor system. The first and second drives are self-contained, mutually independent drives connected to one another by control units. The top-related and bottom-related pairs of conveyor belts of the conveyor system are each driven by self-contained, mutually independent, position-controlled drives.

5 Claims, 6 Drawing Sheets

(51) Int. Cl.

| | |
|---|---|
| ***B26D 5/00*** | (2006.01) |
| ***B26D 7/01*** | (2006.01) |
| *B26D 7/00* | (2006.01) |
| *B26D 7/32* | (2006.01) |

(52) U.S. Cl.
CPC ..... *B26D 2007/0081* (2013.01); *B26D 2007/322* (2013.01); *Y10T 83/647* (2015.04)

(58) Field of Classification Search
USPC ..... 198/626.1–626.5, 817; 83/435.2, 155, 83/155.1, 409, 651
See application file for complete search history.

(56) References Cited

U.S. PATENT DOCUMENTS

| | | | | |
|---|---|---|---|---|
| 7,942,398 | B1 * | 5/2011 | Marcinik | B43M 3/04 198/626.5 |
| 2001/0037708 | A1 | 11/2001 | Matthes et al. | |
| 2003/0094348 | A1 * | 5/2003 | Lee | H05K 13/0061 198/626.1 |
| 2003/0145700 | A1 | 8/2003 | Lindee | |
| 2007/0044616 | A1 | 3/2007 | Matthes et al. | |
| 2011/0132722 | A1 * | 6/2011 | Depoi et al. | 198/373 |

* cited by examiner

CUTTING DEVICE

CROSS-REFERENCE TO RELATED APPLICATION

This application claims the priority, under 35 U.S.C. § 119, of German Patent Application DE 10 2012 005 462.9, filed Mar. 20, 2012; the prior application is herewith incorporated by reference in its entirety.

BACKGROUND OF THE INVENTION

Field of the Invention

The invention relates to a device and a method for the simultaneous three-sided or tri-lateral trimming of products. The device includes a plurality of cutting stations with a common upper knife carrier which is operable in a vertical motion, at least blades for front edge trimming and for top and bottom trimming of the products to be attached to the upper knife carrier, a first drive driving the upper knife carrier, a conveyor system having top-related and bottom-related pairs of conveyor belts for conveying the products through the cutting stations of the device, and a second drive driving the conveyor system, in which the first and second drives are self-contained, mutually independent drives connected to one another by control units.

In the production of brochures, the products, which have been collated and stitched, are cut in a device constructed for three-sided trimming, for example a trimmer. That is carried out in the cutting stations for the trimming of the front edge and the top and/or bottom by using movable upper blades acting against fixed lower blades or cutting bars.

Such a trimmer is known from European Patent Application EP 1 152 310 A1. The trimmer has a common upper knife carrier which is operable in a vertical motion by a servomotor. The upper blades for the front edge trimming and for the top and bottom trimming are mounted on the upper knife carrier. The front edge trimming is carried out in a first cutting station and the top and bottom trimming in a second cutting station. The trimmer has a conveyor system for the products in order to convey the products to the cutting stations and to convey them therefrom. The process of the three-sided trimming is carried out in that case in individual steps. The conveyor system conveys the product to the first cutting station and stops the product in the exact position required. Then the front edge trimming is effected. Subsequently, the product is conveyed by the conveyor system to a second cutting station and stopped in the exact position required. Then top and bottom trimming is effected. Subsequently, the three-sided trimmed product is conveyed to a delivery tray. The conveyor system known from European Patent Application EP 1 152 310 A1 includes top-related and bottom-related pairs of belts between which the product is clamped in a force-locking manner. The pairs of belts in that case are driven through continuous drive shafts by an independent drive, for example by a servomotor. A force-locking connection is one which connects two elements together by force external to the elements, as opposed to a form-locking connection which is provided by the shapes of the elements themselves.

In order to adjust the cutting device to different product formats, the distance between the two pairs of belts also has to be adjusted to the respective product format. In order to facilitate that, moveable form-locking connections between drive shafts and the timing belt pulleys of the conveyor belts are provided. The form-locking connections are in the form of polygonal shafts or splined shafts and, due to the alternating load resulting from accelerating and decelerating the products, are subject to high wear. They can consequently become unserviceable and cause costly repairs. The conveyor belts themselves are also subject to wear and require regular replacement. Changing the conveyor belts requires a lot of work due to the continuous shafts which drive the two pairs of belts. Furthermore, the installation and removal of an additional processing device, for instance a center trimming device, also involves a lot of work.

SUMMARY OF THE INVENTION

It is accordingly an object of the invention to provide a cutting device, which overcomes the hereinafore-mentioned disadvantages of the heretofore-known devices of this general type and which assures reliable conveying of products and at the same time simple adaptation of the device to different product formats.

With the foregoing and other objects in view there is provided, in accordance with the invention, a device for the simultaneous three-sided or tri-lateral trimming of products, comprising a plurality of cutting stations. Moreover, the device has a common upper knife carrier which extends through the cutting stations. The upper knife carrier is operable in a vertical motion by using a first drive. At least the blades for front edge trimming and for top and bottom trimming are mounted on the upper knife carrier. The products are conveyed through the cutting stations of the device by a conveyor system having top-related and bottom-related pairs of conveyor belts. The drives for the vertical motion and the conveyor system are each implemented as self-contained mutually independent drives, and connected to one another by control devices.

The drive for the top-related and bottom-related pairs of conveyor belts of the conveyor system has self-contained mutually independent position-controlled drives for each of the two pairs of conveyor belts. As a result, no form-locking continuous connections prone to wear are required in the drive train. The replacing of the conveyor belts is significantly simplified, as is the installation and removal of additional processing devices, for instance for blank separation or special blanking.

In accordance with another advantageous feature of the invention, the drives of the top-related and bottom-related pairs of conveyor belts are governed by motion profiles through the control units or through a central machine control unit. The motion profiles for the two pairs of belts herein can be identical or different in each case. Thus, it is possible to control conveying of the product from one cutting station to another in such a way that different transport paths are consciously selected for the top and bottom ends of the product in order to achieve the desired cutting result.

Other features which are considered as characteristic for the invention are set forth in the appended claims.

Although the invention is illustrated and described herein as embodied in a cutting device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
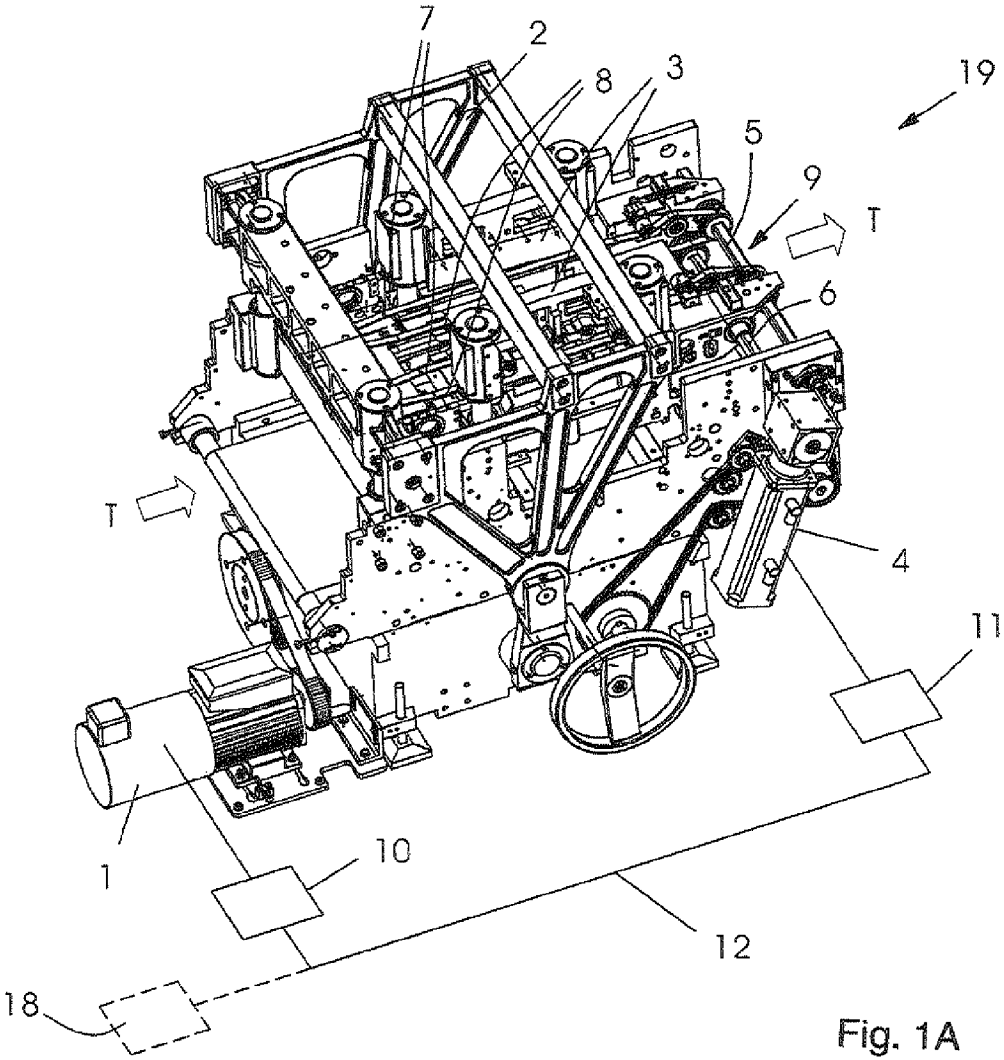
Fig. 1A PRIOR ART
FIG. 1A is a diagrammatic, perspective view of a cutting device with a conveyor system according to the prior art.

Referring now to the figures of the drawings in detail and first, particularly, to FIG. 1A thereof, there is seen a representative example of a cutting device 19 for edge trimming with separate drive devices according to the prior art. A first drive motor 1 generates a motion of an upper knife carrier 2, on which upper blades 3 are mounted. The direction of product flow is indicated by arrows T. A second drive motor 4 drives belts 7, 8 of a conveyor system 9 through respective first and second continuous drive shafts 5, 6. Control units 10, 11 which are provided for the two drive motors 1, 4 can communicate with one another by a connection 12 for an exchange of data and/or control signals. Moreover, the connection 12 can also lead to a central machine control unit 18.

Figure 1B:
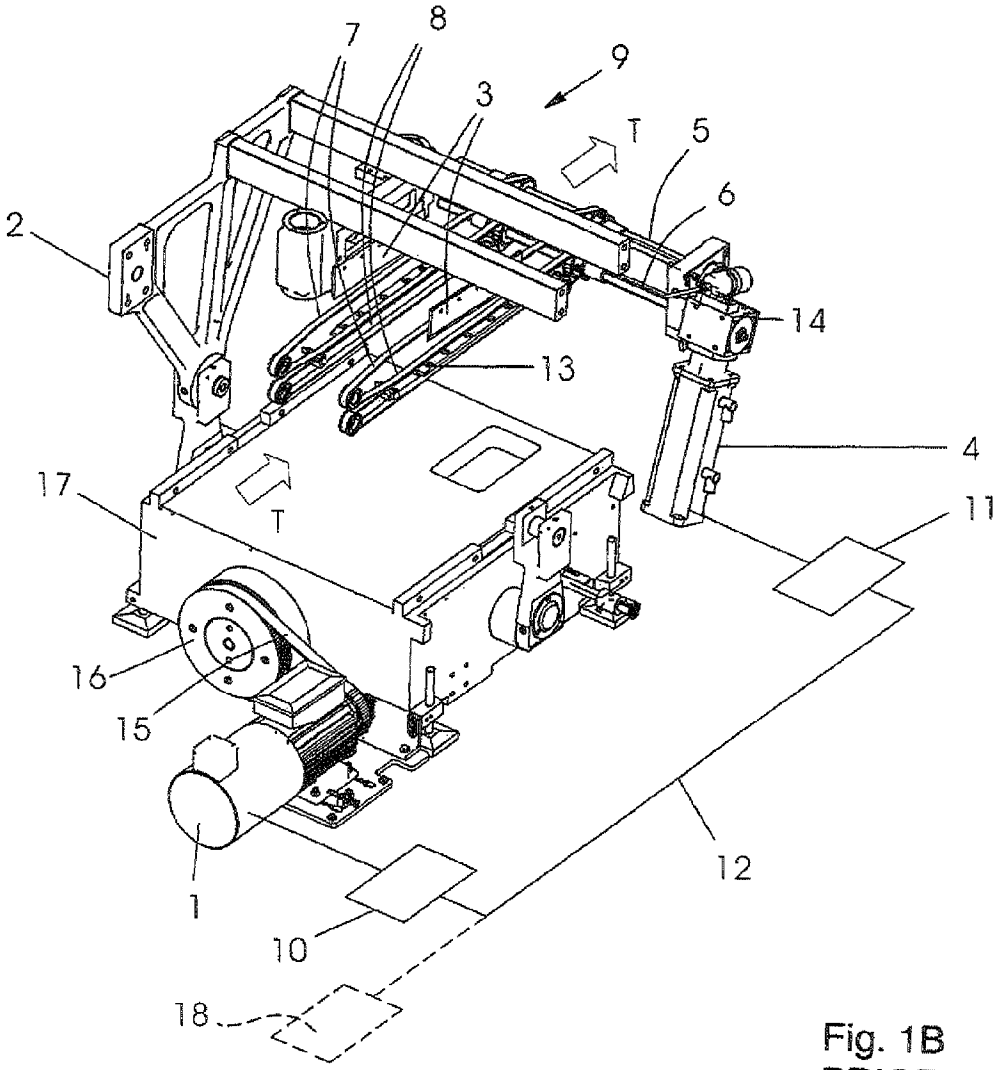
Fig. 1B PRIOR ART
FIG. 1B is a perspective view of drives of the device according to FIG. 1A.

Important elements of the drives generating the two motion sequences are shown in FIG. 1B. The first drive motor 1 generates a vertical anharmonic oscillating motion of the upper knife carrier 2 using a timing belt 15, a timing belt pulley 16 and a transmission 17. During a cutting action, the upper blades 3 are pressed against lower blades 13. The second drive motor 4 drives the shafts 5, 6 by using a mechanical transmission 14, in such a way that the belts 7, 8 of the conveyor system are moved. The arrows T again mark the direction of the product flow.

Figure 2:
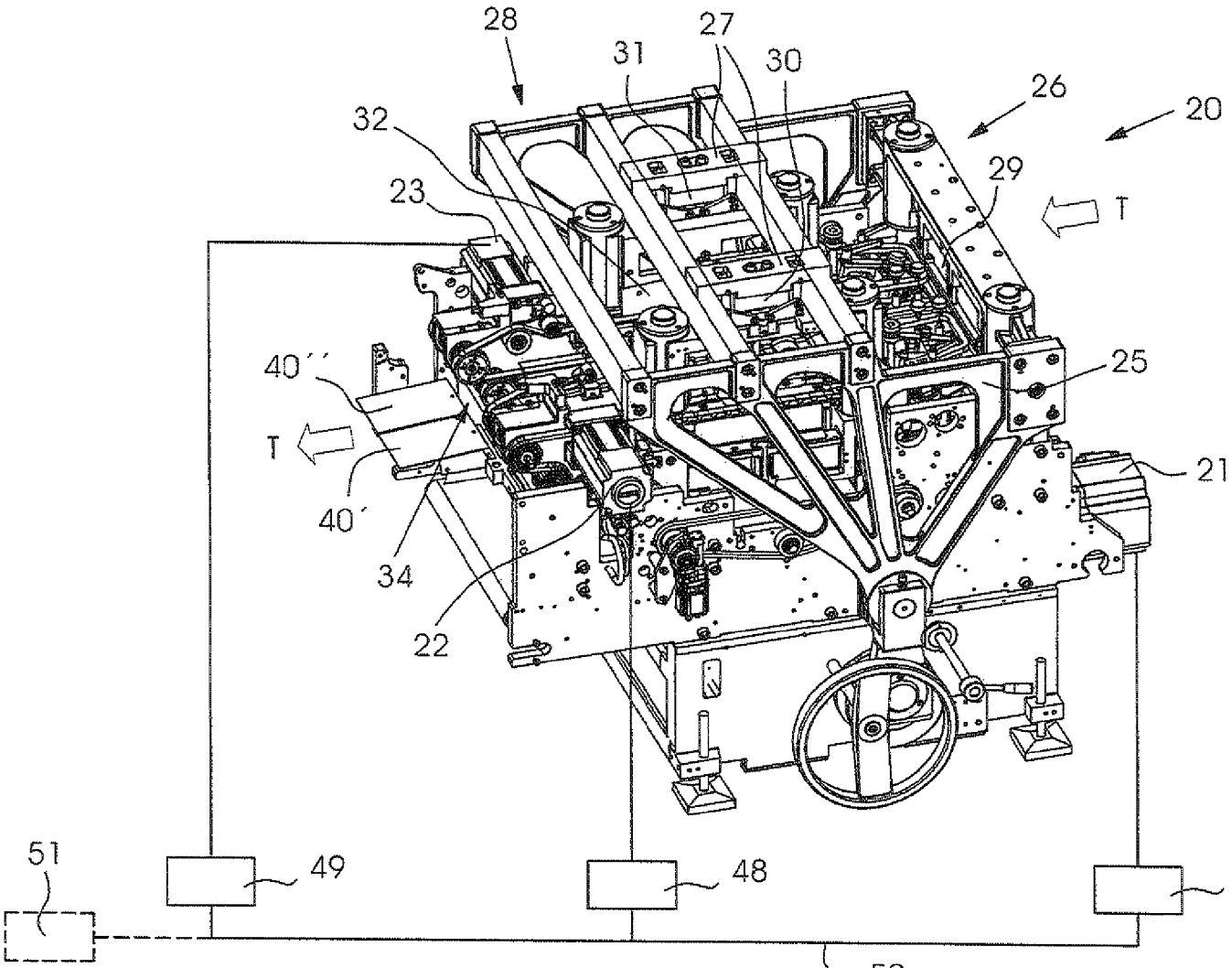
FIG. 2 is a perspective view of a cutting device according to the invention.
Figure 3:
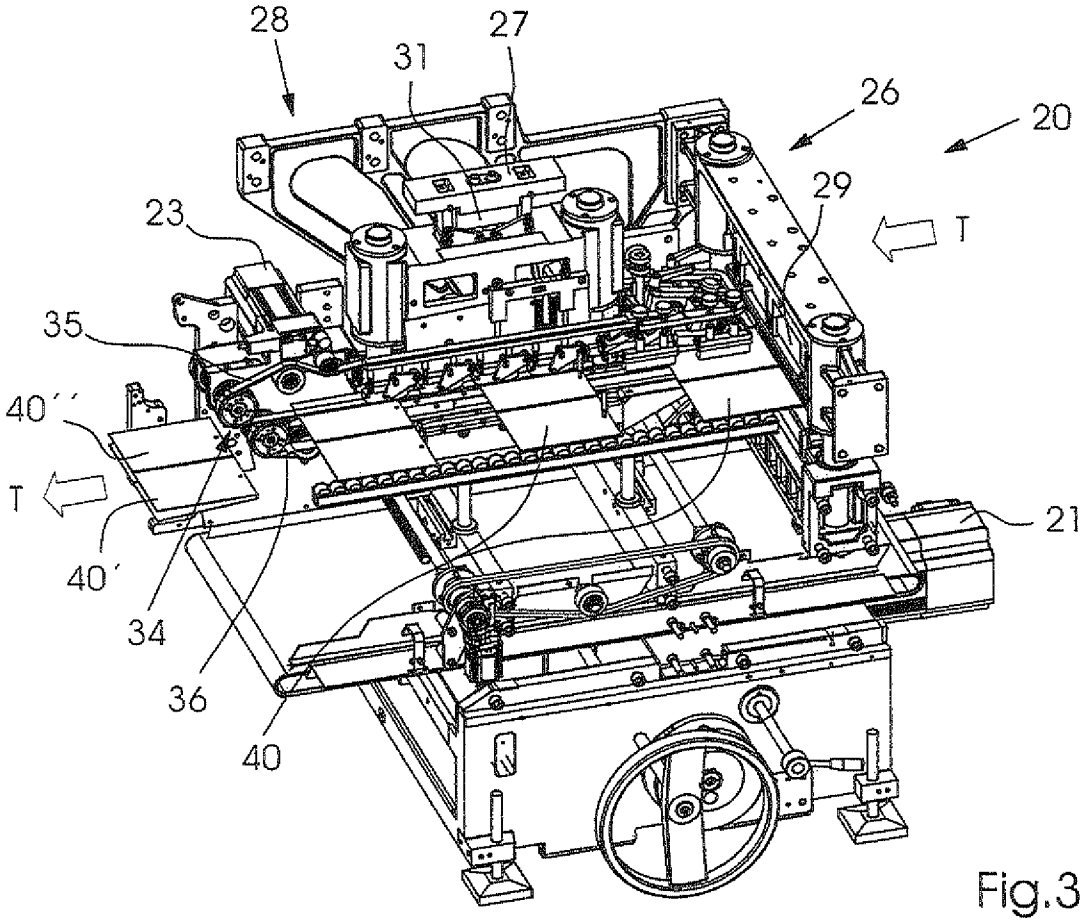
FIG. 3 is a perspective view showing parts of a conveyor system within the device according to the invention shown in FIG. 2.

FIGS. 2 and 3 illustrate a cutting device 20 according to the invention in which, for the sake of clarity, FIG. 3 illustrates only a top-related conveyor system and omits control units and connections. The cutting device 20 has an upper knife carrier 25 which is set into vertical motion by a drive motor 21. The upper knife carrier 25 extends through all of the cutting stations. There are three cutting stations in the present example: a station 26 for front edge trimming, a station 27 for top and bottom trimming and a further processing station 28 for special blankings or for blank separation. Corresponding upper blades 29, 30, 31, 32 are attached to the upper knife carrier and are moved toward lower blades 33 shown in FIG. 4 and thus carry out the edge trimming or special blanking or blank separation of a product 40. The product 40 is conveyed by a conveyor system 34 through the individual cutting stations 26, 27, 28 of the device 20. For this purpose, the conveyor system 34 has top-related 35, 36 and bottom-related 37, 38 pairs of conveyor belts between which the product 40 is clamped. The top-related pairs of conveyor belts 35, 36 are driven by an independent drive motor 23, and the bottom-related pairs of conveyor belts are driven by an independent drive motor 22.

The individual independent drives 21, 22, 23 are linked to one another by way of their respective control units 47, 48, 49 through a connection 50 for the exchange of data and/or control signals. Moreover, they can be additionally connected to a central machine control unit 51. This enables the respective drives 22 and 23 to be governed by a defined motion profile and thus to accelerate and convey the product 40 individually by its top or bottom sides.

Figure 4:
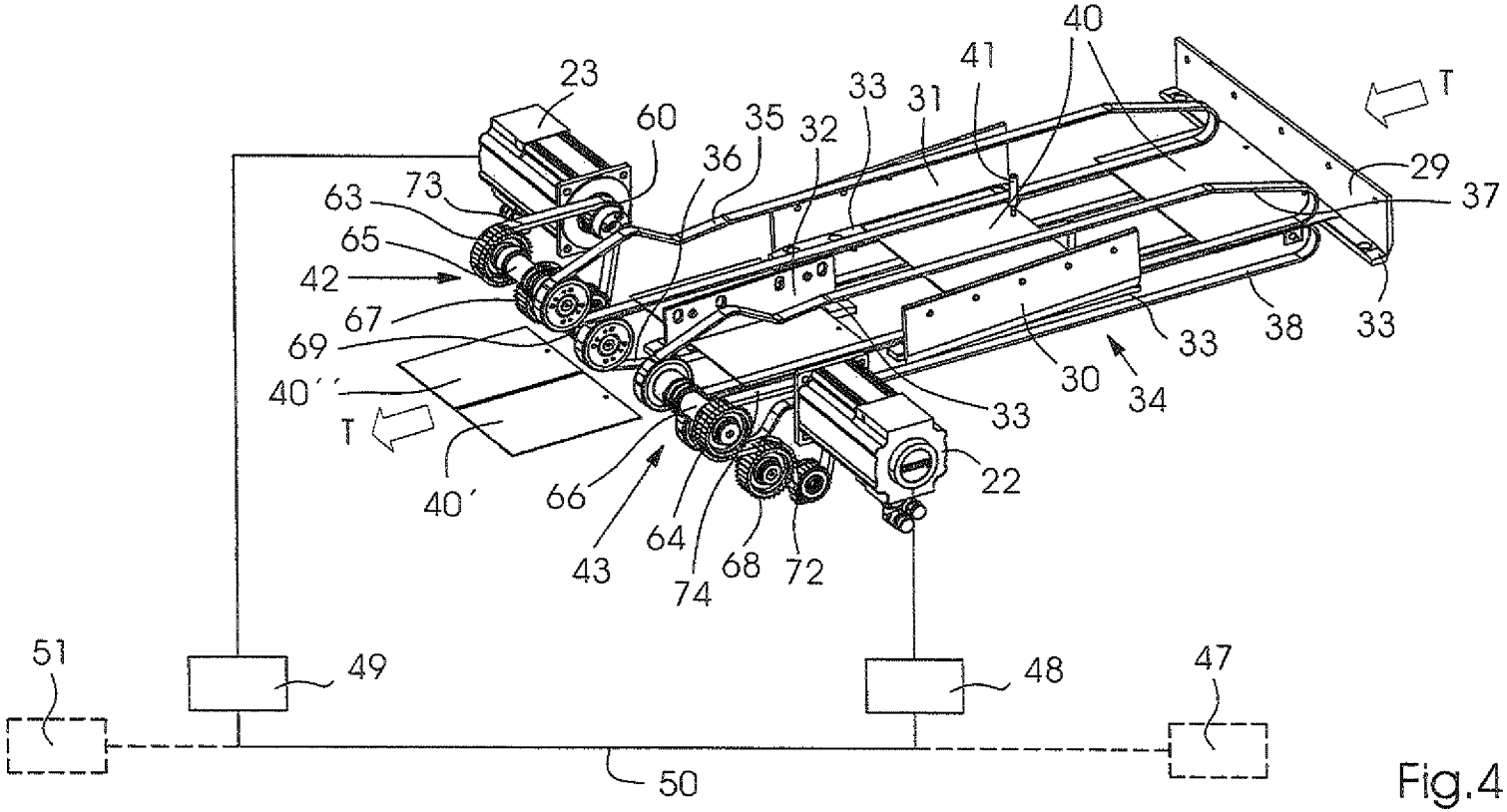
FIG. 4 is a perspective view showing the conveyor system.

FIG. 4 illustrates the important components of the conveyor system 34. The direction of transport of products 40, 40', 40" is illustrated by arrows T. In the present exemplary embodiment, the conveyor system 34 extends through the three cutting stations. In the first station 26, the front edge trimming is effected by the upper blade 29 and the lower blade 33. In the second station 27, the top and bottom trimming is effected by the upper blades 31, 30 and the lower blade 33. In the third station 28, blank separation is effected by using the separating blade 32 and the lower blade 33. In the second or third station, special blanking can also be carried out, in addition, by using corresponding cutting dies 41. During the cutting, the product 40 remains stationary. After completion of the respective cutting operation the product 40 is conveyed to the next cutting station. The conveyance of the products is carried out by using the two pairs of conveyor belts 35, 36, 37, 38 which are disposed opposite one another in pairs and clamp the product in each case at the top side and the bottom side in a force-locking manner.

The top-related 35, 36 and bottom-related 37, 38 pairs of conveyor belts are each driven by the respective independent drive motors 22, 23 with respective components of drive trains 42, 43. Each of the two drive trains 42, 43 is formed from the following components:

- timing belt pulleys 60, 61 on motor shafts (the timing belt pulley 61 being concealed FIG. 4);
- timing belt pulleys 63, 64 for driving shafts 65, 66 for the upper belts 35, 37;
- timing belt pulleys 67, 68 for driving shafts 69, 70 for the lower belts 36, 38 (the shaft 70 being concealed in FIG. 4);
- timing belt pulleys 71, 72 used as deflection and tensioning devices (the timing belt pulley 71 being concealed in FIG. 4); and
- timing belts 73, 74 with toothing on two sides.

The product 40 is accelerated by the conveyor system 34 within the device 20, conveyed in the correct position to the respective cutting station and then decelerated until stopped. This operation is repeated for further processing steps and finally for conveying the product from the device 20 to a conveyor system disposed downstream of the device 20, to a processing device or to a delivery tray.

Figure 5:
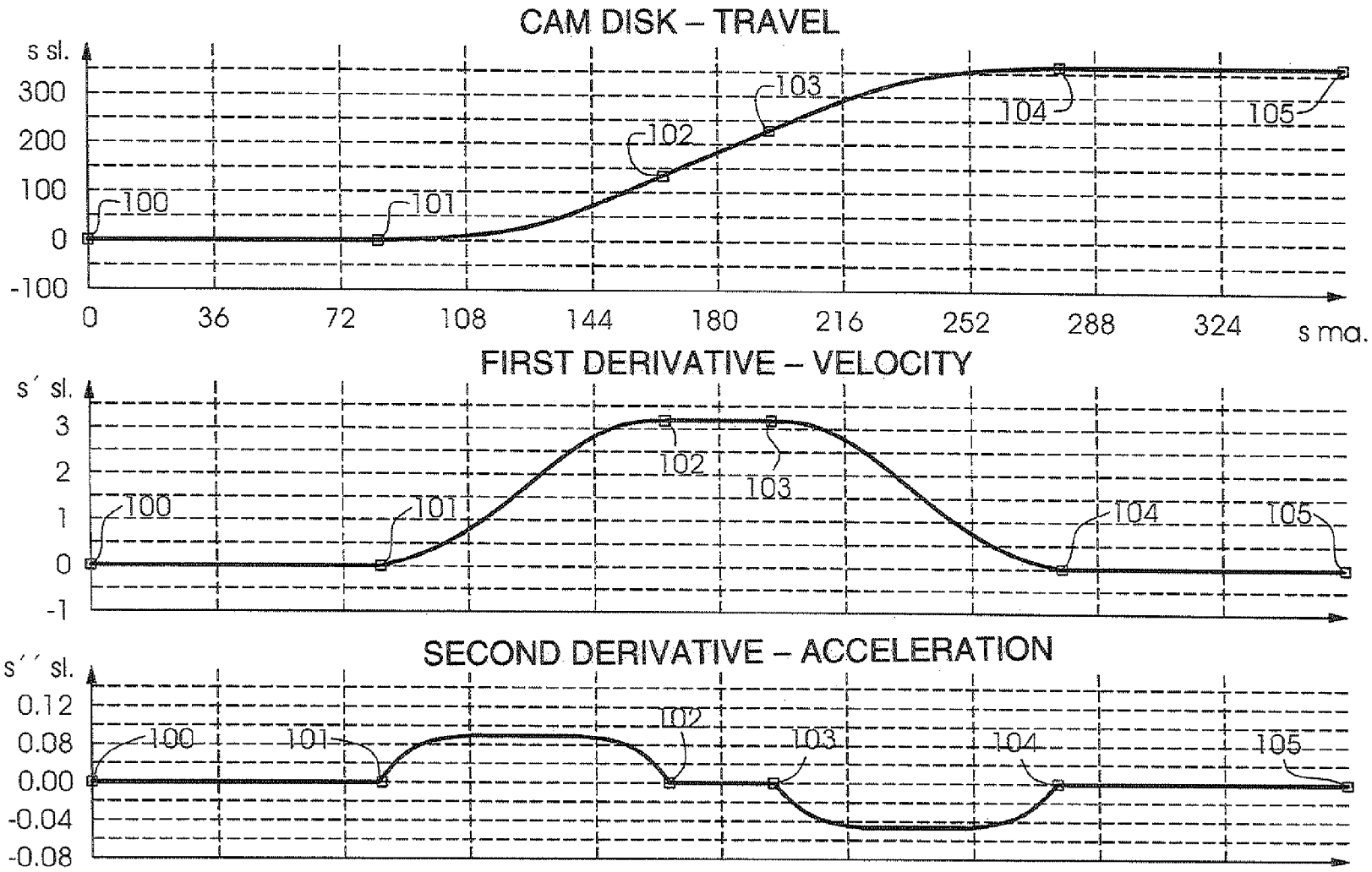
FIG. 5 is a graph showing a motion profile of the conveyor system.

FIG. 5 shows, by way of example, a possible motion profile of a pair of conveyor belts for an entire working cycle (0-360°) of the cutting device. In FIG. 5, the upper diagram illustrates the travel of a cam disk in degrees of rotation, the diagram in the center illustrates the first derivative as standardized velocity (ds/dPhi) and the lower diagram illustrates the second derivative as standardized acceleration (dv/dPhi), each over 0°-360° (x axis), corresponding to a machine cycle. Reference numerals 100, 105 respectively indicate the bottom dead center of the upper knife carrier at 0° and 360°. At this point, the cutting operation is completed but the product is not yet released. Accordingly, the pair of conveyor belts is not yet in motion. At a point 101 the product is released and the conveying operation can commence. Accordingly, at the point 101 the travel of the cam disk is still zero, as is the velocity. The acceleration of the conveyor belts commences at the point 101, as is shown in the lower diagram of FIG. 5. The acceleration of the conveyor belts continues until a point 102 (approx. 164°). Up to there the cam disk has covered a distance of approximately 130 degrees of rotation and the conveyor belts are moving at a standardized velocity of 3.2. No further acceleration occurs until a point 103, with the conveyor belts thus continuing to move at the same velocity. From the point 103 to a point 104 the positioning of the product in the next cutting station takes place or a new product is positioned in the first cutting station. Accordingly, the conveyor belts are correspondingly decelerated until stopped. From the point 104 to a point 105 the belts remain stationary. In the respective cutting station the product is clamped by using non-illustrated clamping bars, the upper knife carrier is lowered to its bottom dead center and thus the edge trimming of the product 40 is carried out.

The invention claimed is:

1. A device for simultaneous three-sided trimming of products with different product formats, the device comprising:

a plurality of cutting stations;

an upper knife carrier associated in common with said plurality of cutting stations and configured to operate in a vertical motion;

blades configured to be attached to said upper knife carrier and configured for at least front edge trimming and top and bottom trimming of the products;

a first self-contained, independent drive driving said upper knife carrier;

a conveyor system having top-related and bottom-related pairs of conveyor belts for conveying the products through said cutting stations;

second self-contained, mutually independent, position-controlled drives each driving a respective one of said top-related and bottom-related pairs of conveyor belts of said conveyor system;

said top-related pairs of conveyor belts being driven by a first one of said second position-controlled drives with components of a first drive train defined by a first timing belt pulley on a motor shaft of said first one of said position-controlled drives, a second timing belt pulley on a first driving shaft of a first upper belt and a third timing belt pulley on a second driving shaft of a first lower belt, a fourth timing belt pulley as a deflection and tensioning device and a first timing belt having toothing on two sides for driving all said timing belt pulleys of said first drive train;

said bottom-related pairs of conveyor belts of said conveyor system being driven by a second one of said position-controlled drives with components of a second drive train defined by a fifth timing belt pulley on a motor shaft of said second one of said second position-controlled drives, a sixth timing belt pulley on a third driving shaft of a second upper belt and a seventh timing belt pulley on a fourth driving shaft of a second lower belt, an eighth timing belt pulley as a deflection and tensioning device and a second timing belt having toothing on two sides for driving all said timing belt pulleys of said second drive train;

said first and second drive trains being self-contained and mutually independent; and control units interconnecting said first self-contained, independent drive and said second position-controlled drives.

2. The device according to claim 1, wherein said control units govern said second position-controlled drives of said top-related and bottom-related pairs of conveyor belts using motion profiles.

3. The device according to claim 2, wherein said motion profiles for said second position-controlled drives of said top-related and bottom-related conveyor belts are identical.

4. The device according to claim 1, which further comprises a central machine control unit connected to said second position-controlled drives of said top-related and bottom-related pairs of conveyor belts.

5. A device for simultaneous three-sided trimming of products with different product formats, the device comprising:

a plurality of cutting stations;

an upper knife carrier associated in common with said plurality of cutting stations and configured to operate in a vertical motion;

blades configured to be attached to said upper knife carrier and configured for at least front edge trimming and top and bottom trimming of the products;

a first self-contained, independent drive driving said upper knife carrier;

a conveyor system having top-related and bottom-related pairs of conveyor belts for conveying the products through said cutting stations;

second self-contained, mutually independent, position-controlled drives each driving a respective one of said top-related and bottom-related pairs of conveyor belts of said conveyor system;

said top-related pairs of conveyor belts being driven by a first one of said second position-controlled drives with components of a first drive train defined by a first timing belt pulley on a motor shaft of said first one of said position-controlled drives, a second timing belt pulley on a first driving shaft of a first upper belt and a third timing belt pulley on a second driving shaft of a first lower belt, a fourth timing belt pulley as a deflection and tensioning device and a first timing belt having toothing on two sides for driving all said timing belt pulleys of said first drive train;

said bottom-related pairs of conveyor belts of said conveyor system being driven by a second one of said position-controlled drives with components of a second drive train defined by a fifth timing belt pulley on a motor shaft of said second one of said second position-controlled drives, a sixth timing belt pulley on a third driving shaft of a second upper belt and a seventh timing belt pulley on a fourth driving shaft of a second lower belt, an eighth timing belt pulley as a deflection and tensioning device and a second timing belt having toothing on two sides for driving all said timing belt pulleys of said second drive train;

said first and second drive trains being self-contained and mutually independent; and control units interconnecting said self-contained, independent drive and said second position-controlled drives, said control units governing said second position-controlled drives of said top-related and bottom-related pairs of conveyor belts using motion profiles, said motion profiles for said second position-controlled drives of said top-related and bottom-related conveyor belts are different from one another.

* * * * *